US007775762B2

(12) United States Patent
Koenig

(10) Patent No.: US 7,775,762 B2
(45) Date of Patent: Aug. 17, 2010

(54) PUMP HEADER BODY AND MODULAR MANIFOLD

(76) Inventor: Kevin J. Koenig, 8465 Number Two Rd. East, Manlius, NY (US) 13104

( * ) Notice: Subject to any disclaimer, the term of this patent is extended or adjusted under 35 U.S.C. 154(b) by 740 days.

(21) Appl. No.: 11/691,775

(22) Filed: Mar. 27, 2007

(65) Prior Publication Data

US 2007/0224034 A1 Sep. 27, 2007

Related U.S. Application Data

(63) Continuation-in-part of application No. 11/277,556, filed on Mar. 27, 2006, now Pat. No. 7,507,066.

(51) Int. Cl.
*F04B 23/04* (2006.01)

(52) U.S. Cl. ..... 415/60; 415/151; 415/203; 415/912

(58) Field of Classification Search ..... 415/60, 415/148, 151, 182.1, 203, 912
See application file for complete search history.

(56) References Cited

U.S. PATENT DOCUMENTS

| | | | | |
|---|---|---|---|---|
| 3,286,639 | A | 11/1966 | Hutton | |
| 4,173,234 | A | 11/1979 | Thomas | |
| 4,397,418 | A | 8/1983 | Johansson | |
| 4,643,652 | A | 2/1987 | Eberhardt | |
| 5,119,988 | A * | 6/1992 | Fiedrich | 237/8 C |
| 5,154,584 | A | 10/1992 | McEwen | |
| 5,443,207 | A | 8/1995 | Genga | |
| 5,622,221 | A | 4/1997 | Genga, Jr. | |
| 5,664,939 | A | 9/1997 | Giordan | |
| 6,082,976 | A | 7/2000 | Kempf | |
| 6,126,081 | A | 10/2000 | Calvin | |
| 6,345,770 | B1 | 2/2002 | Simensen | |
| 6,712,027 | B2 | 3/2004 | Rocheleau | |
| 6,799,943 | B2 | 10/2004 | Racer | |
| 2004/0050231 | A1 | 3/2004 | Chu | |
| 2004/0262412 | A1 | 12/2004 | Sweet | |
| 2005/0257843 | A1 | 11/2005 | Simensen | |
| 2006/0016903 | A1 | 1/2006 | Sweet | |

FOREIGN PATENT DOCUMENTS

| | | |
|---|---|---|
| EP | 0484305 | 5/1996 |

* cited by examiner

*Primary Examiner*—Igor Kershteyn
(74) *Attorney, Agent, or Firm*—Marjama Muldoon Blasiak & Sullivan LLP

(57) ABSTRACT

A modular header body is described for distributing fluid to an individually pumped fluid circuit. The modular header body has a valve to selectively isolate the header body's suction chamber from its volute, which permits a pump motor to be disconnected from the header body while the valve is closed. Each modular header body is constructed so that adjacent header bodies can be connected to each other to form a common suction chamber. Each header body's isolation valve operates independently so that the volute of one header body can be isolated from the common suction chamber without affecting fluid supply to the other header bodies.

14 Claims, 4 Drawing Sheets

PUMP HEADER BODY AND MODULAR MANIFOLD

CROSS-REFERENCE TO RELATED APPLICATIONS

The present application is a continuation in part of and claims priority to Applicant's co-pending U.S. application Ser. No. 11/277,556, filed Mar. 27, 2006.

FIELD OF THE INVENTION

The present invention relates to a header body and modular manifold for use with a pump to distribute fluids to a fluid-circulation circuit that is part of a system of multiple fluid-circulation circuits.

BACKGROUND OF THE INVENTION

In systems that employ multiple fluid-circulation circuits, such as hydronic heating systems, each circuit typically includes a dedicated pump. Each circuit's pump is connected to a header body, from which it obtains the fluid that is delivered to the circuit and through which it discharges fluid to the circuit. Multiple pump header bodies are connected to a manifold from which they obtain fluid for a plurality of circuits.

Each header body includes a suction chamber, which is in fluid communication with the input manifold, and a discharge, which is in fluid communication with the fluid circuit. Each header body also includes a volute, which receives the impeller from a pump motor. It is in the volute that the pump's impeller creates the fluid pressure differential that induces fluid flow from the header body's suction chamber to its discharge.

Generally, a plurality of header body and pump combinations are positioned adjacent each other so that each header body delivers fluid to one of a plurality of fluid circuits. It is beneficial to reduce the space required for each header body.

It occasionally is necessary to disconnect a pump from its header body for maintenance or replacement. In addition, it is sometimes useful to install a fluid circulation circuit without installing a pump motor if the circuit is one that will not immediately be used (e.g., a hydronic heating circuit for space that is reserved for future expansion). To avoid having to drain fluid from the circuit when the pump motor is removed, it is necessary to provide a valve at the header body discharge. To avoid having to disturb fluid flow to adjacent circuits when the pump motor is removed, it is necessary to provide a valve or other means to isolate each header body volute from the header body suction chamber.

It is therefore a principal object and advantage of the present invention to provide a header body that can be connected to an adjacent header body to form a compact, modular manifold for providing fluid to a plurality of pumps, each connected to a separate fluid circulation circuit.

It is a further object and advantage of the present invention to provide a header body with an integral valve for selectively separating the header body volute from the header body suction chamber.

It is yet another object and advantage of the present invention to provide a header body with an integral valve for separating the header body volute from the header body outlet.

SUMMARY OF THE INVENTION

In accordance with the foregoing objects and advantages, the present invention provides a modular header body for connecting to a pump motor, a fluid source and a fluid circulation circuit. The modular header body comprises a suction chamber in fluid communication with the fluid source, a discharge for providing fluid to the fluid circulation circuit, and a volute for receiving an impeller connected to the pump motor and for forcing fluid through the discharge. A valve is provided for selectively isolating the volute from the suction chamber. Adjacent header bodies can be connected to form a common suction body, so that a plurality of connected header bodies forms a manifold for supplying fluid to a plurality of individually pumped circuits.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
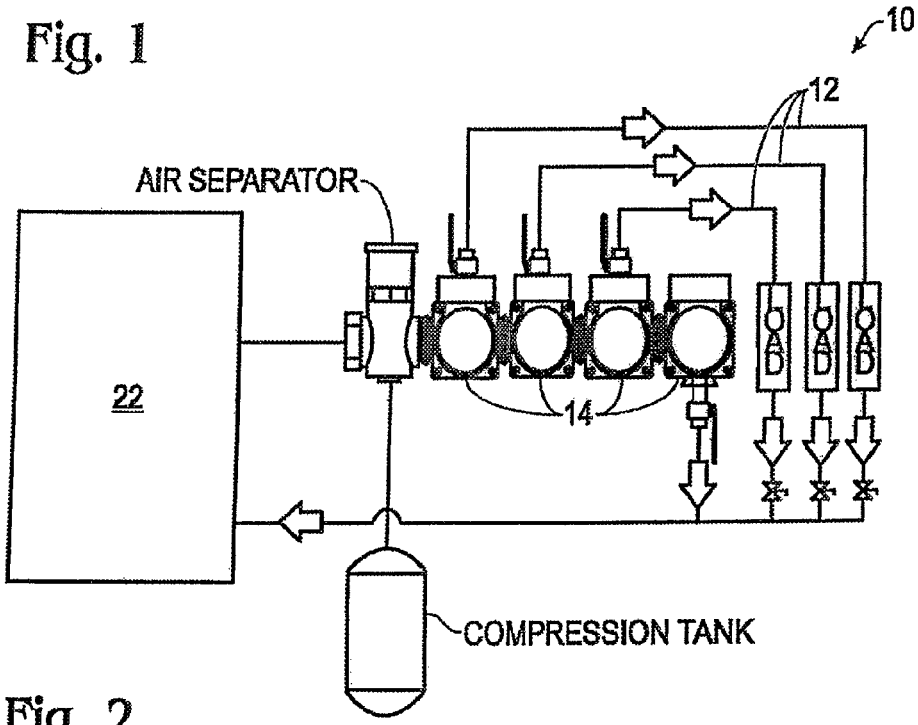
FIG. 1 is a schematic view of a hydronic heating system that includes a plurality of modular header bodies according to the present invention.
Figure 2:
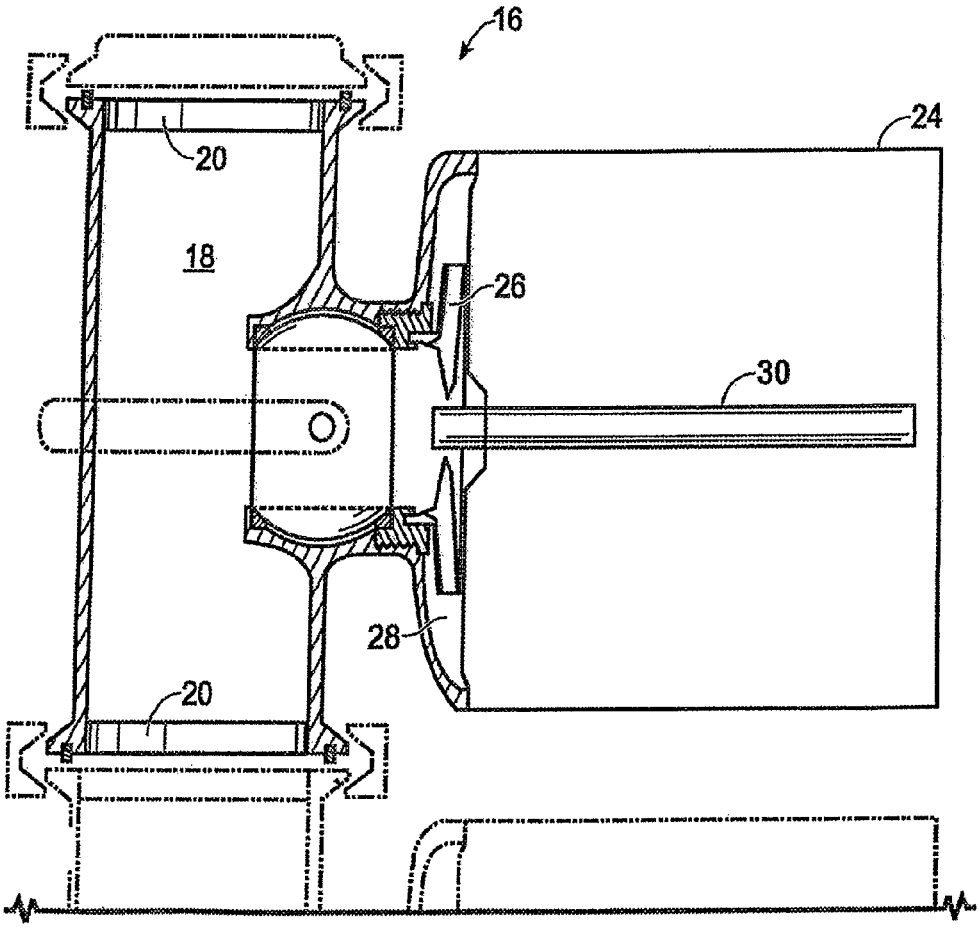
FIG. 2 is a sectional bottom view of a header body according to the present invention, with the volute valve open.

Referring now to the drawings, wherein like reference numerals refer to like parts throughout, there is seen in FIG. 1 a hydronic heating system 10 having a plurality of circuits 12. Heated fluid is forced through each circuit 12 by a pump 14. Each pump 14 is connected to a header body 16 (FIG. 2). Each header body 16 includes suction chamber 18, which is open at each end 20. Preferably, each end 20 is circular in shape with a flanged rim. Two header bodies 16 can be connected to form a contiguous suction chamber 18 by joining the two header bodies 16 at one of their respective suction chamber ends 20. The preferred means of connection is using a quick clamp fitting, such as Andron Stainless part no. AC13HP, but other means known in the art are acceptable, such as flange fittings and the like. When a particular header body 16 is the last one in a row of header bodies 16, one end 20 of the suction chamber 18 can be closed with a cap. When a particular header body 16 is the first one in a row of header bodies, one end 20 of the suction chamber 18 is in fluid communication with a fluid source, such as a boiler 22 or hot water tank.

Figure 3:
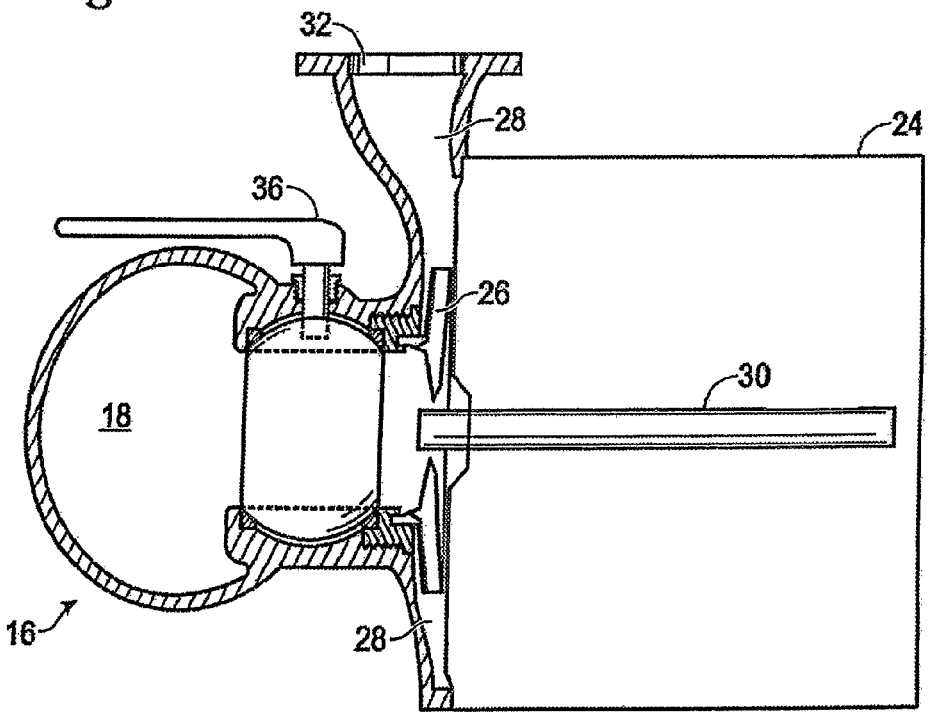
FIG. 3 is a sectional side view of a header body according to the present invention, with the volute valve open.
Figure 4:
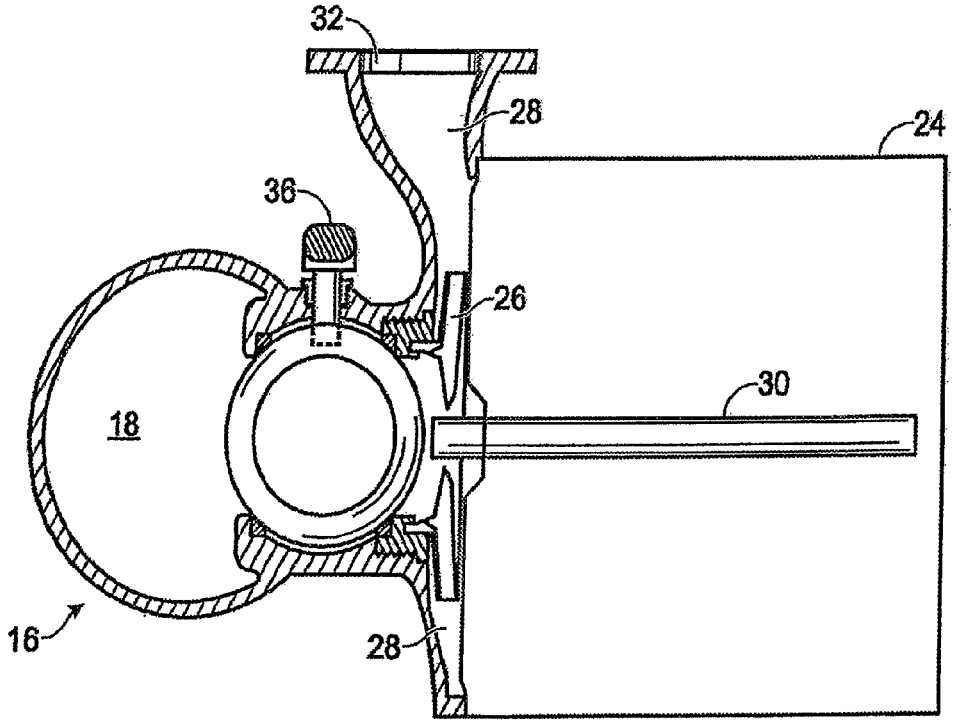
FIG. 4 is a sectional side view of a header body according to the present invention, with the volute valve closed.

Referring now to FIGS. 3 and 4, there is shown a header body 16 with pump motor 24 attached. Pump motor 24 is attached to header body 16 using threads or other connection means known in the art. Pump motor 24 includes an impeller 26, which rotates in volute 28 and rotates on impeller shaft 30.

Figure 5:
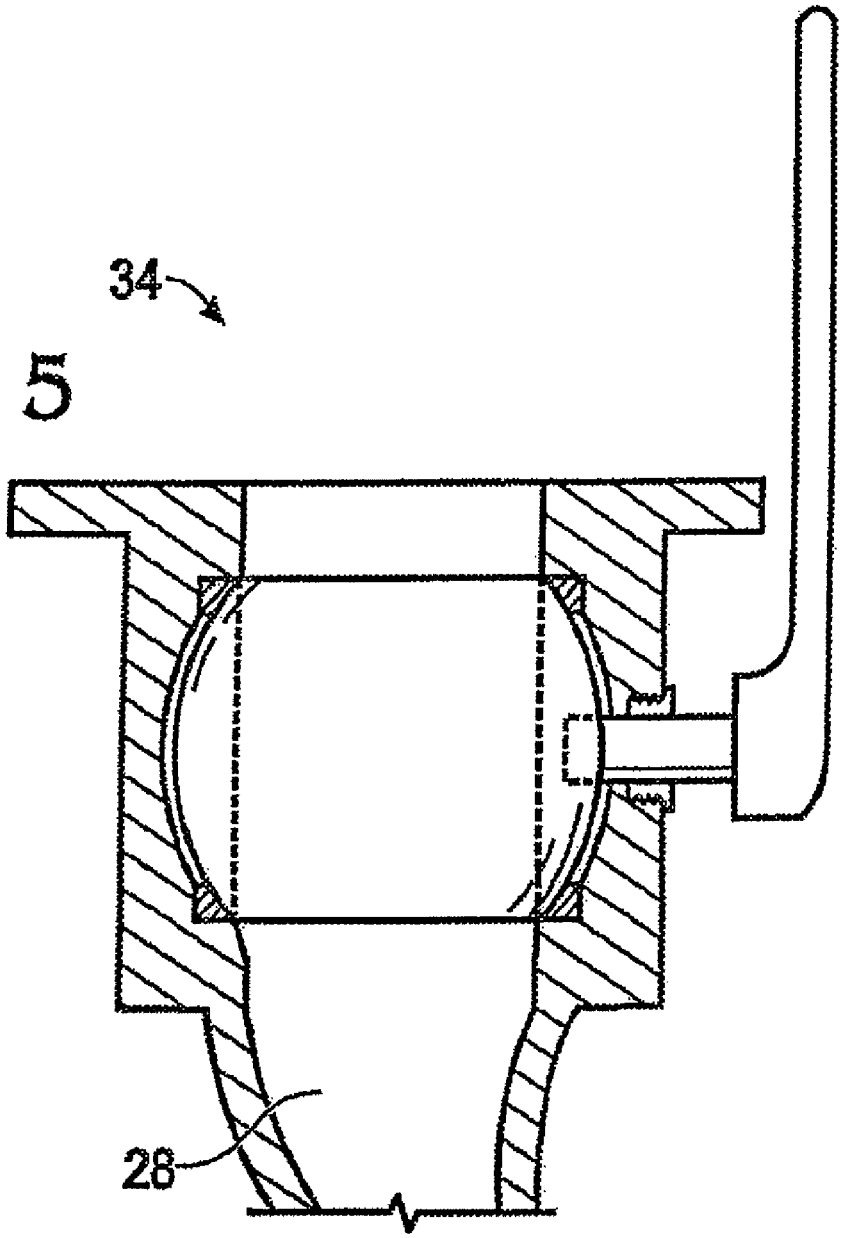
FIG. 5 is a sectional side view of a header body according to another embodiment of the present invention.

Header body discharge 32 is preferably a flange fitting, but may also be threaded, barbed or compression, as is known in the art. Typically, an external valve will be connected to header body discharge 32. Optionally, header body discharge 32 includes a circuit isolation valve 34 (FIG. 5). Circuit isolation valve 34 may be a check valve to prevent fluid flow from the circuit back to the header body, or it may be a control valve that can be selectively operated to isolate the header body 16 from the circuit, or it may be a combination control and check valve.

Header body 16 includes volute isolation valve 36, which selectively isolates volute 28 from suction chamber 18. In normal operation of pump motor 24, volute isolation valve 36 is open, allowing impeller 26 to draw fluid from suction chamber 18 and deliver it to header body discharge 32 under positive pressure. If pump motor 24 is removed from header body 16, volute isolation valve 36 is closed (FIG. 4) so that fluid does not flow from suction chamber 18 to volute 28. If header body discharge 32 includes a circuit isolation valve 34, it is also closed so that fluid does not flow from the circuit into the header body 16.

According to the present invention, when a plurality of header bodies 16 have been connected to form a common suction chamber 18, it is possible to close the volute isolation valve 36 of one of the header bodies 16 without negatively affecting the fluid flow through the common suction chamber 18, which supplies fluid to the remaining header bodies 16.

Because the relationship between the ends 20 of each header body's suction chamber 18 is not directional, it is possible to connect one or more header bodies 16 in an inverted position relative to adjacent header bodies 16. For example, as shown in FIG. 1, one header body 16 may be positioned to discharge fluid in a downward direction while adjacent header bodies 16 are positioned to discharge fluid in an upward direction.

Figure 6:
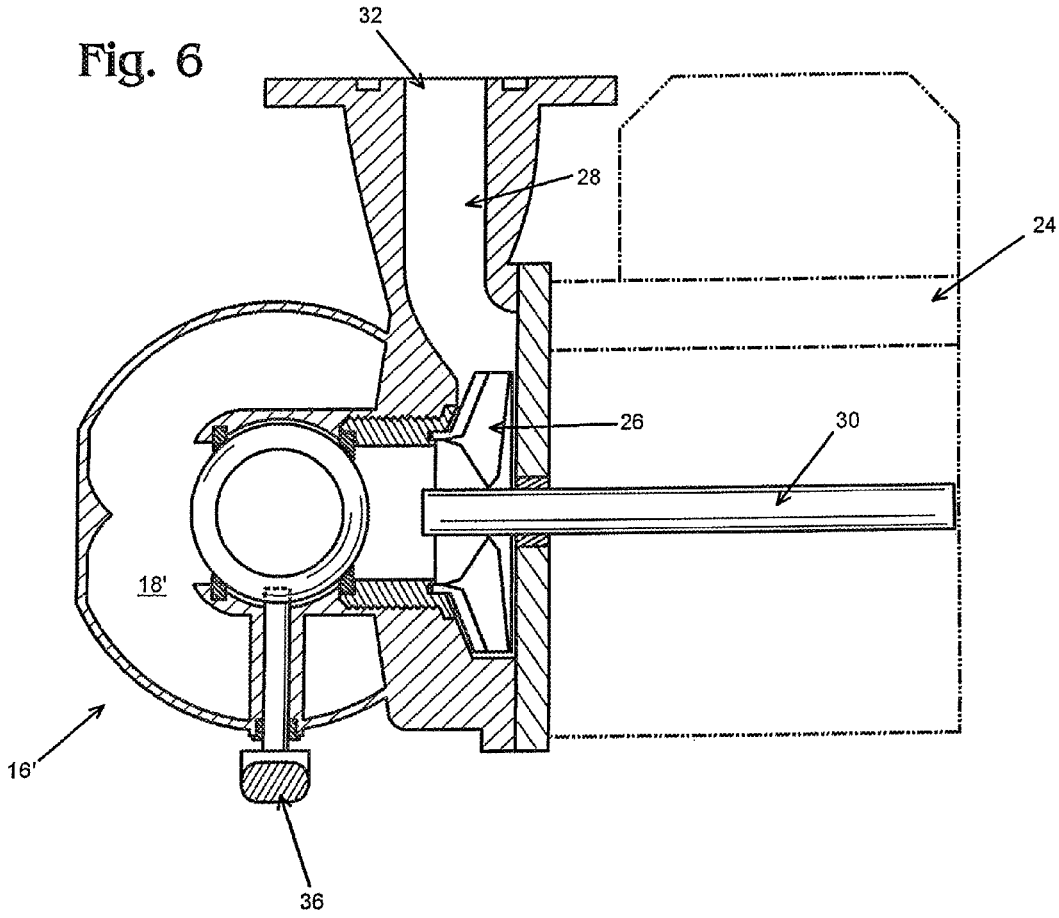
FIG. 6 is a sectional side view of a header body according to an alternative embodiment of the present invention, with the volute valve closed.

Referring now to FIG. 6, an alternative embodiment of a header body 16', with pump motor 24 attached and volute isolation valve 36 in the closed position, is shown. This embodiment is similar in most respects to the embodiments shown in FIGS. 3 and 4 and described supra, except that the header body 16' shown in FIG. 6 comprises a minimized dimension configuration (which reduces the size of the pump 14). In short, suction chamber 18' is located more proximately to the pump motor 24, than is the suction chamber 18 of the header body 16 as shown in FIGS. 3 and 4. Also, the volute isolation valve 36 is more centrally located and encapsulated within the suction chamber 18'. This arrangement makes the volute isolation valve 36 unnoticeable from the outside of the suction chamber 18, and fluid may flow around the volute isolation valve 36. This minimized dimension configuration allows the header body of an embodiment of the present invention to be installed in locations where limited space may be an issue.

What is claimed is:

1. A modular header body for connecting to a pump motor, a fluid source, and a fluid circulation circuit, said modular header body comprising:

a suction chamber in fluid communication with the fluid source, said suction chamber having a first opening at a first end and a second opening at a second end;

a discharge for providing fluid to the fluid circulation circuit;

a volute for receiving an impeller connected to the pump motor and for forcing fluid through said discharge; and a valve encapsulated within said suction chamber, the valve for selectively isolating said volute from said suction chamber, wherein at least one of said first opening and said second opening is configured to be connected to a second modular header body, wherein fluid is prevented from flowing from said suction chamber to said volute responsive to removing said motor from said volute when said valve is in a closed state.

2. The modular header body of claim 1 wherein said discharge further comprises a discharge valve.

3. The modular header body of claim 2 wherein said discharge valve is a check valve.

4. The modular header body of claim 2 wherein said discharge valve is a control valve.

5. A manifold in communication with a fluid source for providing fluid to a plurality of fluid circulation circuits, said manifold comprising:

a plurality of header bodies, each header body comprising:

a suction chamber in fluid communication with the fluid source, said suction chamber having a first opening at a first end and a second opening at a second end;

a discharge for providing fluid to one of said plurality of fluid circulation circuits;

a volute for receiving an impeller connected to a pump motor and for forcing fluid through said discharge; and a valve encapsulated within the suction chamber, the valve for selectively isolating said volute from said suction chamber, wherein fluid is prevented from flowing from said suction chamber to said volute responsive to removing said motor from said volute when said valve is in a closed state, wherein the suction chamber of each of the header bodies is configured to be connected to the suction chamber of an adjacent one of said plurality of header bodies to form a common suction chamber.

6. The manifold of claim 5 wherein the discharge of each of said plurality of header bodies further comprises a discharge valve.

7. A modular header body for connecting to a pump motor, fluid source and fluid circulation circuit, comprising:

a suction chamber in fluid communication with the fluid source, said suction chamber having a first opening at a first end and a second opening at a second end;

a discharge for providing fluid to the fluid circulation circuit;

a volute for receiving an impeller connected to the pump motor and for forcing fluid through said discharge; and a valve encapsulated within the suction chamber, for selectively isolating said volute from said suction chamber;

wherein at least one of said first opening, said second opening is configured to be connected to a second modular header body.

8. The modular header body of claim 7 wherein said discharge further comprises a discharge valve.

9. The modular header body of claim 7 wherein said discharge valve is a check valve.

10. The modular header body of claim 7 wherein said discharge valve is a control valve.

11. A manifold in communication with a fluid source for providing fluid to a plurality of fluid circulation circuits, said manifold comprising:

a plurality of header bodies, each header body comprising:

a suction chamber in fluid communication with the fluid source, said suction chamber having a first opening at a first end and a second opening at a second end;

a discharge for providing fluid to one of said plurality of fluid circulation circuits; a volute for receiving an impeller connected to a pump motor and for forcing fluid through said discharge; and a valve encapsulated within the suction chamber;

for selectively isolating said volute from said suction chamber;

wherein the suction chamber of each of said plurality of header bodies is configured to be connected to the suction chamber of an adjacent one of said plurality of header bodies to form a common suction chamber.

12. The manifold of claim 11 wherein the discharge of each of said plurality of header bodies further comprises a discharge valve.

13. A manifold in communication with a fluid source for providing fluid to a plurality of fluid circulation circuits, said manifold comprising:

a plurality of header bodies, each header body comprising:

a suction chamber in fluid communication with the fluid source, said suction chamber having a first opening at a first end and a second opening at a second end;

a discharge for providing fluid to one of said plurality of fluid circulation circuits;

a volute for receiving an impeller connected to a pump motor and for forcing fluid through said discharge; and a valve encapsulated within the suction chamber for selectively isolating said volute from said suction chamber;

wherein the suction chamber of each of said plurality of header bodies is configured to be connected to the suction chamber of an adjacent one of said plurality of header bodies to form a common suction chamber; and wherein at least one header body of said plurality of header bodies is located in an inverted position relative to an adjacent header body.

14. The manifold of claim 13 wherein the discharge of each of said plurality of header bodies further comprises a discharge valve.

* * * * *